US008764851B2

(12) United States Patent
Ghosh et al.

(10) Patent No.: US 8,764,851 B2
(45) Date of Patent: Jul. 1, 2014

(54) ANTIMICROBIAL FABRICS MADE USING SOL-GEL/N-HALAMINE CHEMISTRY, AND METHODS OF MAKING SAME

(75) Inventors: Subhas Ghosh, Ypsilanti, MI (US); Vijaykumar Mannari, Saline, MI (US)

(73) Assignee: Eastern Michigan University, Ypsilanti, MI (US)

( * ) Notice: Subject to any disclaimer, the term of this patent is extended or adjusted under 35 U.S.C. 154(b) by 0 days.

(21) Appl. No.: 13/428,461

(22) Filed: Mar. 23, 2012

(65) Prior Publication Data

US 2012/0240345 A1 Sep. 27, 2012

Related U.S. Application Data

(60) Provisional application No. 61/467,074, filed on Mar. 24, 2011.

(51) Int. Cl.

| | |
|---|---|
| ***D06M 23/00*** | (2006.01) |
| ***D06M 11/09*** | (2006.01) |
| ***D06M 11/67*** | (2006.01) |
| ***D06M 11/77*** | (2006.01) |

(52) U.S. Cl.

USPC ..... 8/116.1; 8/115.51; 8/115.6; 252/8.61; 252/8.91; 442/59; 442/63; 442/64; 442/123; 442/152; 442/157; 427/299; 427/301; 427/322; 427/324; 427/331; 427/337; 427/343; 427/344

(58) Field of Classification Search

USPC ..... 8/115.6, 116.1, 181, 192, 115.51; 252/8.61, 8.91; 442/59, 63, 64, 123, 442/152, 157; 427/299, 301, 322, 324, 331, 427/337, 343, 344

See application file for complete search history.

(56) References Cited

U.S. PATENT DOCUMENTS

| | | | | |
|---|---|---|---|---|
| 5,882,357 | A | 3/1999 | Sun et al. | |
| 6,077,319 | A | 6/2000 | Sun et al. | |
| 6,679,922 | B1 | 1/2004 | Sun et al. | |
| 6,768,009 | B1 | 7/2004 | Sun et al. | |
| 6,770,287 | B1 | 8/2004 | Sun et al. | |
| 6,962,608 | B1 | 11/2005 | Sun et al. | |
| 7,084,208 | B2 | 8/2006 | Sun et al. | |
| 7,541,398 | B2 | 6/2009 | Sun et al. | |
| 2004/0127667 | A1 * | 7/2004 | Worley et al. | 528/10 |
| 2011/0305844 | A1 * | 12/2011 | Rosing et al. | 427/396 |

OTHER PUBLICATIONS

Yadav, Sangeeta, "A Study of Antimicrobial Properties of Fabric Treated with Silane and N-halamine Complex" (Jan. 1, 2009).*

Subhas Ghosh et al., "Recent Developments in Sol-Gel Chemistry to Enhance the Fabric Properities", Recent Research Developments in Applied Polymer Science vol. 4, pt. II (2009), ISBN 978-81-308-0347-0, S. G. Pandalai, ED., pp. 331-350.

* cited by examiner

*Primary Examiner* — Lorna M Douyon

*Assistant Examiner* — Amina Khan

(74) *Attorney, Agent, or Firm* — Carrier Blackman & Associates, P.C.; William D. Blackman; Anne G. Sabourin

(57) ABSTRACT

Methods of treating fabrics using sol-gel halamine chemistry to impart antimicrobial properties thereto are described, as well as fabrics produced by the described methods. In one embodiment, the antimicrobial fabrics may be used to fabricate antimicrobial divider curtains for use in hospitals and medical facilities.

2 Claims, 2 Drawing Sheets

ANTIMICROBIAL FABRICS MADE USING SOL-GEL/N-HALAMINE CHEMISTRY, AND METHODS OF MAKING SAME

GOVERNMENT LICENSE RIGHTS

This invention was made with government support under ARMY/SSC W911QY-07-C-0525 and W911QY-08-C-0147 by the U.S. Army Soldier Systems Center. The Government has certain rights in the invention.

CROSS-REFERENCE TO RELATED APPLICATIONS

The present application claims priority under 35 U.S.C. 119(e), based on U.S. provisional patent application 61/467,074, filed 24 Mar. 2011. The entire disclosure of this priority document, including specification, claims, and drawings, is incorporated by reference herein.

BACKGROUND OF THE INVENTION

1. Field of the Invention

The present invention relates to methods of treating fabrics to impart antimicrobial properties thereto, and to fabrics produced by the method. More particularly, the present invention relates to a method of treating fabrics using sol-gel halamine chemistry to impart antimicrobial properties thereto, and to antimicrobial fabrics produced by the described method.

2. Description of the Background Art

Textile products, particularly those made from natural fibers, are vulnerable to microorganism growth and resultant deterioration, because of the large surface area and hydrophilic nature of such textiles. The use of antimicrobial agents for textiles has become important to avoid cross-infection by pathogenic microorganisms, to prevent or minimize infestation by microbes, and to arrest metabolism in microbes in order to reduce odor. The use of antimicrobial-treated fabric protects garments from staining, discoloration, and deterioration.

Weapons of mass destruction have become a growing international threat during the past decade. Important pathogens of interest among these types of weapons is the use of such airborne "biological/chemical warfare agents" as *Bacillus anthracis* (anthrax), *Salmonella typhi* (typhoid fever), *Vibrio cholerae, Yersinia pestis* (plague), variola virus (smallpox), etc.

An effective antimicrobial treatment of textile fabric becomes necessarily for the protection of individuals in the event of such attacks. These fabrics should be comfortable to wear, aesthetically pleasing, and functionally durable.

Some efforts have been made to create antimicrobial fabric treatments and other antimicrobial agents, including the approaches discussed in U.S. Pat. Nos. 5,882,357, 6,077,319, 6,768,009, 6,770,287, 6,962,608, 6,679,922, 7,084,208, and 7,541,398.

Although the known antimicrobial fabric treatment and compositions have some utility for their intended purposes, a need still exists in the art for a durable, long-lasting antimicrobial fabric treatment. In particular, there is a need for an improved antimicrobial fabric treatment which will overcome the difficulties encountered with the known art. In addition, there is a need for antimicrobial fabrics which can be used in partition divider curtains used in hospitals and medical clinics.

SUMMARY OF THE INVENTION

The present invention provides an improved method of treating fabrics using sol-gel halamine chemistry to impart antimicrobial properties thereto, and to antimicrobial fabrics produced by the described method.

In a first illustrative embodiment hereof, the present invention provides a first method of treating a fabric material to add an antimicrobial property to the fabric, the method including steps of:

(a) Reacting an isocyanate group of a silane with an NH site of a hydantoin to forum a silane-hydantoin adduct;

(b) Applying the silane-hydantoin adduct to a fabric material having cellulosic content;

(c) Bonding the silane-hydantoin adduct to said fabric material in a substitution reaction to generate a silane-hydantoin substituted fabric material; and (d) Reacting the silane-hydantoin substituted fabric material with a solution containing chlorine to create an antimicrobial fabric product having an N-halamine structure thereon.

In a second embodiment hereof, the present invention provides a second, alternate method of treating a fabric material to add an antimicrobial property to the fabric, the method including steps of:

(a) reacting a first NH site of a hydantonin with a solution containing chlorine to produce a chlorinated hydantonin;

(b) reacting an isocyanate group of a silane with another NH site of the chlorinated hydantoin to forum a silane-hydantoin adduct;

(c) applying the silane-hydantoin adduct to a fabric material having cellulosic content; and (d) bonding the silane-hydantoin adduct to said fabric material in a substitution reaction to generate an antimicrobial fabric product having an N-halamine structure thereon.

The present invention also relates to an antimicrobial fabric material which is a product of the described method. In one illustrative embodiment, the antimicrobial fabric material hereof may be used to form medical partition curtains.

For a more complete understanding of the present invention, the reader is referred to the following detailed description section, which should be read in conjunction with the accompanying drawings.

DETAILED DESCRIPTION OF ILLUSTRATIVE EMBODIMENTS

Figure 1:
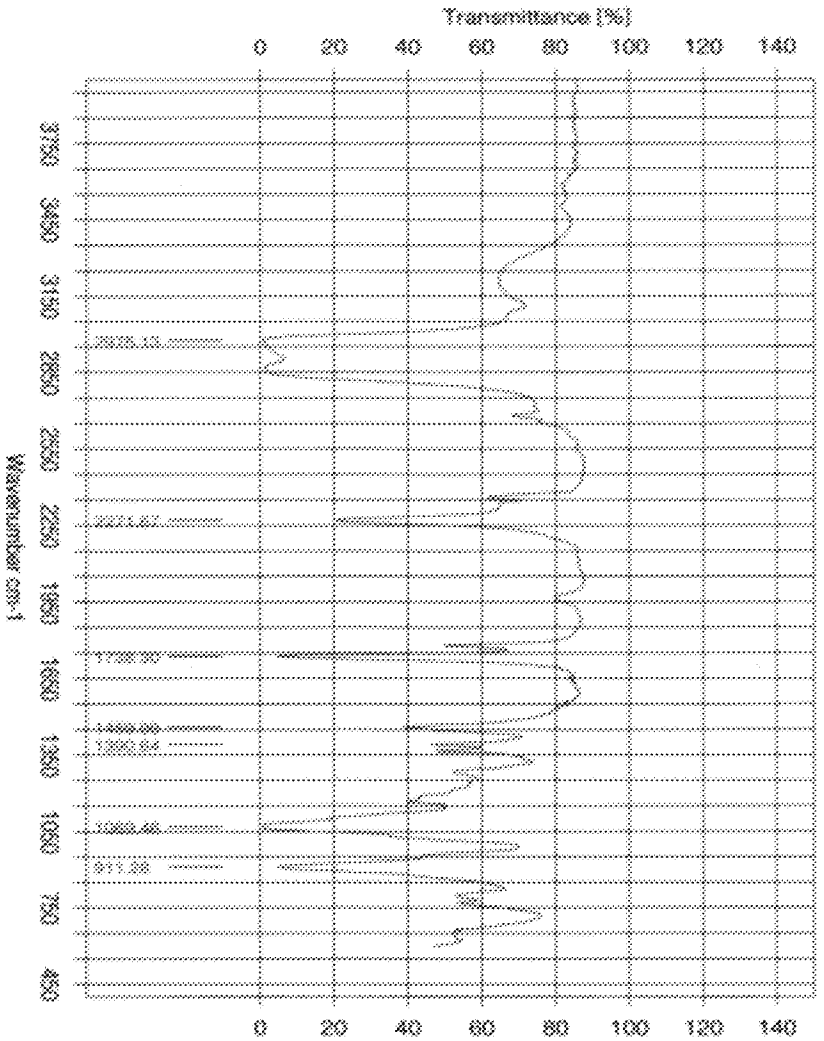
FIG. 1 is an FTIR spectrum of unreacted DMH and CPTES solution showing the presence of the NCO peak at 2271 $cm^{-1}$.

Although exemplary embodiments of the present application are explained herein in detail, it is to be understood that the examples given are intended to illustrate, rather than to limit the invention, and the invention is not limited in its application to the details of construction and the arrangement of components set forth in the following description or illustrated in the following drawings. The invention is capable of other embodiments and of being practiced or of being carried out in various ways.

First Method

In a first embodiment hereof, the present invention provides a first method of treating a fabric material, according to a first embodiment, to add an antimicrobial property thereto, the method including a first step of reacting an isocyanate group of a silane with an NH site of a hydantoin to forum a silane-hydantoin adduct.

A specific synthesis process is followed such as, e.g., the process set out in the following examples.

The method according to the first embodiment also involves a step of applying the silane-hydantoin adduct to a fabric material having cellulosic content, which may be accomplished using a drip-dry-cure method.

The method according to the first embodiment also involves a step of covalently bonding the silane-hydantoin adduct to the fabric material in a substitution reaction to generate a silane-hydantoin substituted fabric material.

The method according to the first embodiment also involves a step of reacting the silane-hydantoin substituted fabric material with a solution containing chlorine, to create an antimicrobial fabric product having an N-halamine structure thereon. A stoichiometric amount of chlorine is added to convert an NH group to an N—Cl group.

Alternate Method

In a second embodiment hereof, the present invention provides a second, alternate method of treating a fabric material to add an antimicrobial property to the fabric, the method including a first step of reacting a first NH site of a hydantonin with a solution containing chlorine to produce a chlorinated hydantonin.

The method according to the second embodiment also involves a step of reacting an isocyanate group of a silane with another NH site of the chlorinated hydantoin to forum a silane-hydantoin adduct.

The method according to the second embodiment also involves a step of applying the silane-hydantoin adduct to a fabric material having cellulosic content.

The method according to the second embodiment also involves a step of bonding the silane-hydantoin adduct to said fabric material in a substitution reaction to generate an antimicrobial fabric product having an N-halamine structure thereon.

In a particular illustrative embodiment of the present invention, either of the above methods of improving the antimicrobial property of textiles involves using a unique combination of N-halamine and isocyanatopropyltriethoxysilane ("CPTES").

A schematic representation of the synthesis of a γ-isocyantopropyltriethoxysilane and dimethyl hydantoin adduct ("DMH-CPTES adduct") is shown in Scheme 1.

Scheme 1. Synthesis of γ-isocyantopropyltriethoxysilane and dimethyl hydantoin adduct ("DMH-CPTES adduct").

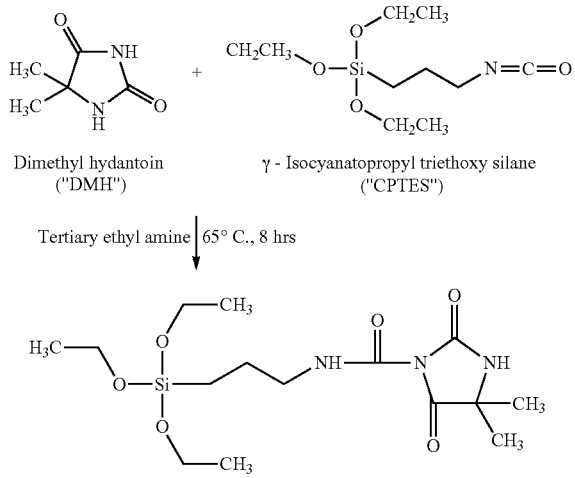

As shown in Scheme 1, the isocyanate group of the silane reacts with one NH site of dimethyl hydantoin ("DMH") while the other NH site of the resulting DMH-CPTES adduct is available to form a bond with chlorine upon treatment with NaOCl to provide the active N—Cl group which acts a powerful antimicrobial agent. This provides rechargeable and durable antimicrobial properties to the fabric, and such antimicrobial fabric is not known to have any health hazards.

The bonding of the DMH-CPTES adduct to cellulose is shown in Scheme 2.

Scheme 2: Bonding of the DMH-CPTES adduct to cellulose.

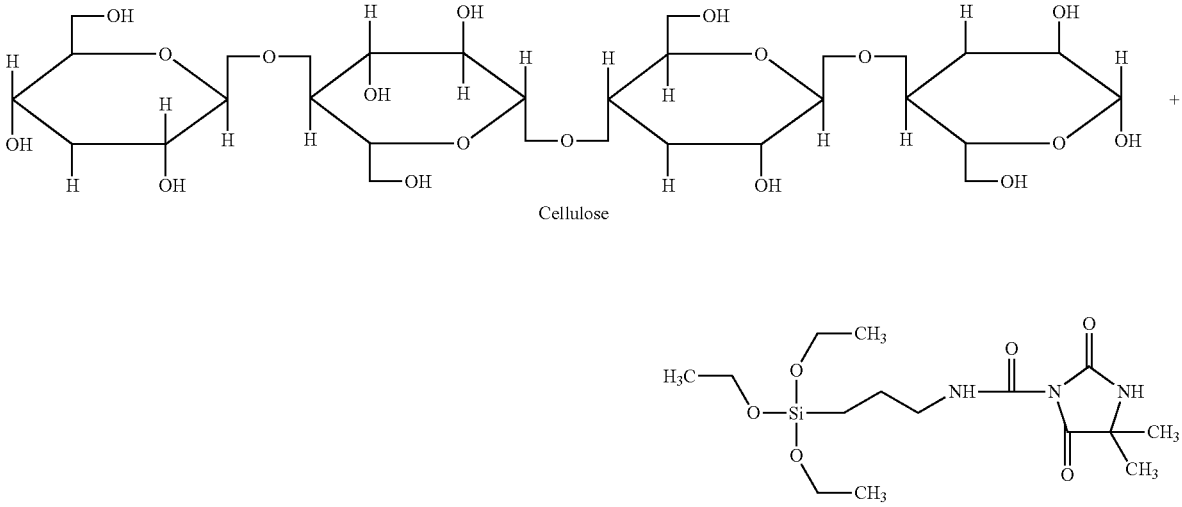

-continued

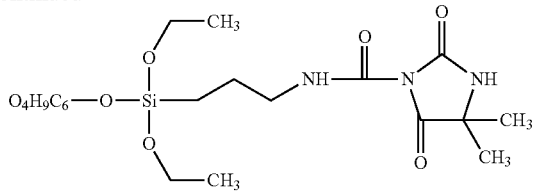

Treatment of the DMH-CPTES adduct bound to cellulose with sodium hypochlorite solution, which introduces chlorine as an antimicrobial agent onto the fabric and imparts antimicrobial properties to the treated fabric, is shown in Scheme 3. As shown in Scheme 3, chlorine forms a bond with DMH in the DMH-CPTES adduct, creating the N-halamine (N—Cl) structure. The NaOCl solution concentration can be adjusted to between about 5-10% according to the fabric treated. The treated fabric may then be chlorinated using NaOCl. In some embodiments, the NaOCl concentration may be about 6%. In some embodiments, the NaOCl concentration may be about 10%.

Scheme 3. Treatment of DMH-CPTES adduct bound to cellulose with sodium hypochlorite.

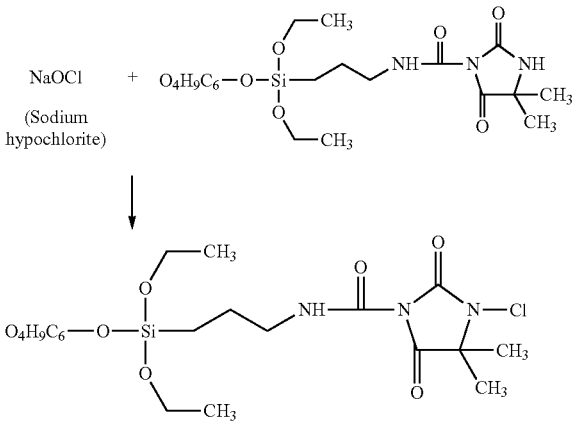

In some embodiments of the present application, the DMH-CPTES adduct may be prepared and then applied to a fabric substrate. In some embodiments, the fabric substrate may include, for example, a Nylon/Cotton, 50/50, blend fabric. In some embodiments, the DMH-CPTES adduct may be applied to the fabric substrate using a pad-dry-pad-dry-cure method.

The DMH-CPTES adduct formation can be checked by determining the NCO value of the solution. This solution can also be evaluated by FTIR. The FTIR spectrogram should show the disappearance of the band at 2271 $cm^{-1}$, in the adduct that was present in the solution before the adduct was formed.

EXAMPLES

Materials:

A substrate was desized, scoured and dyed, 6.72 oz/yd$^2$ 50/50 Nylon/Cotton blend fabric. 100% cotton, 50/50 blend of Polyester cotton utilized. 5,5-Dimethyl hydantoin ("DMH"), 97% (M.P 174° C.) was obtained from Aldrich Chemical Co. Ltd. (used as obtained). Bromophenol Blue A.C.S. reagent, sodium hypochlorite, available chlorine 10-13% (B.P 111° C.) (reagent grade), tetrahydrofuran, minimum 99% (B.P 65-67° C., M.P—108° C.), dimethyl sulfoxide anhydrous 99.9+% (B.P 189° C.), triethylamine, and acetone were obtained from Sigma Aldrich Inc. and used without further purification. Silquest A-Link 25 γ-Isocyanatopropyltriethoxysilane ("CPTES")(B.P 238° C.) was obtained from Momentive and used without further purification.

Example 1

Preparation of DMH-CPTES Adduct

The following is one example of a recipe useful to synthesize about 340 gm of adduct.

Chemicals are obtainable from Sigma Aldrich chemicals and used as received.

1. 5-5 Di methyl hydantoin (DMH): 29.29 grams
2. Cynatopropyltriethoxysilane (CPTES): 56.23 grams
3. Acetone: 291.6 grams
4. Dimethyl sulphoxide (DMSO): 24.3 grams Reaction Temperature: 60-65 degree Celsius.

Reaction time: 8-9 hours.

Total output to expect: 90% of total reaction mixture.

The DMH-CPTES adduct was prepared according to the following procedure. Weighing of chemicals: DMH and CPTES were reacted in the mole ratio of 1:½. A solution of DMH was prepared in acetone and DMSO. A 10% solution of triethylamine in THF was used as a catalyst. Then CPTES was added to the above reaction mixture. The above prepared reaction mixture was added to the reactor. Connections of the reactor with condenser, nitrogen cylinder and temperature controller were made. Temperature controller was set at 65° C. (the boiling point of acetone). The stirrer was started and the reaction was allowed to run for 8 hours.

Example 2

Application of DMH-CPTES Adduct to 50/50 Nylon/Cotton Substrate

A 50/50 Nylon/Cotton blend fabric was finished using the pad-dry-pad-dry-cure method where a padder was used for application of chemical and an oven was used to prepare the samples.

Two fabric specimens of dimension 10"×10" were used for application. Concentrated DMH-CPTES adduct solution (250 mL) prepared as described in Example 1 was poured in the padding mangle trough.

Samples were immersed in the solution for 2 hours and then padded on the Laboratory Padder LP (LAB-PRO GmbH, CH— 4806 Wikon) at a padding pressure of 0.12 MPa. The fabric was passed between the rollers at 0.12 MPa padding pressure in order to remove the excess chemical from surface.

The treated samples were dried at 80° C. for 1 hour and then immersed in the solution for 2 hours and padded again. Finally the sample was dried overnight and cured at 130° C. for 25 minutes.

Example 3

Estimation of the Degree of Reaction of DMH and CPTES

NCO is a significant bond representing CPTES and this is the active bond site which reacts with the NH site of the hydantoin ring. The aim was to react one NH site with NCO of CPTES, while the remaining NH group on the DMH would be allowed to react with chlorine. The important test to determine the degree of reaction is to find the NCO content before and after the reaction by using the titration method illustrated in the method section. The isocyanate component of the DMH-CPTES adduct can be calculated using the following equation:

$$\% NCO = \frac{(B - S) \times N \times 4.202}{W} \quad (1)$$

Where B=Blank reading
S=burette reading with sample
N=normality of the HCL
W=weight of the sample The % NCO of the treated and untreated fabric samples was calculated using Equation (1) as described above. The % NCO content in the samples is shown in Table 1.

TABLE 1

% NCO content in treated and untreated fabric samples

| Sample | % NCO |
|---|---|
| Untreated sample | 13.0 |
| Treated sample | 2.63 |

It can be observed in Table 1 that there is a significant reduction in the % NCO content in the treated fabric sample. This confirms the formation of DMH-CPTES adduct between CPTES and DMH. The degree of reaction was calculated to be 80%. Following this it can be concluded that 80% reaction was completed and % NCO has reduced after reaction because of the complex formation between CPTES and DMH.

Example 4

IR Spectroscopic Analysis of DMH-CPTES Adduct Formation

Figure 2:
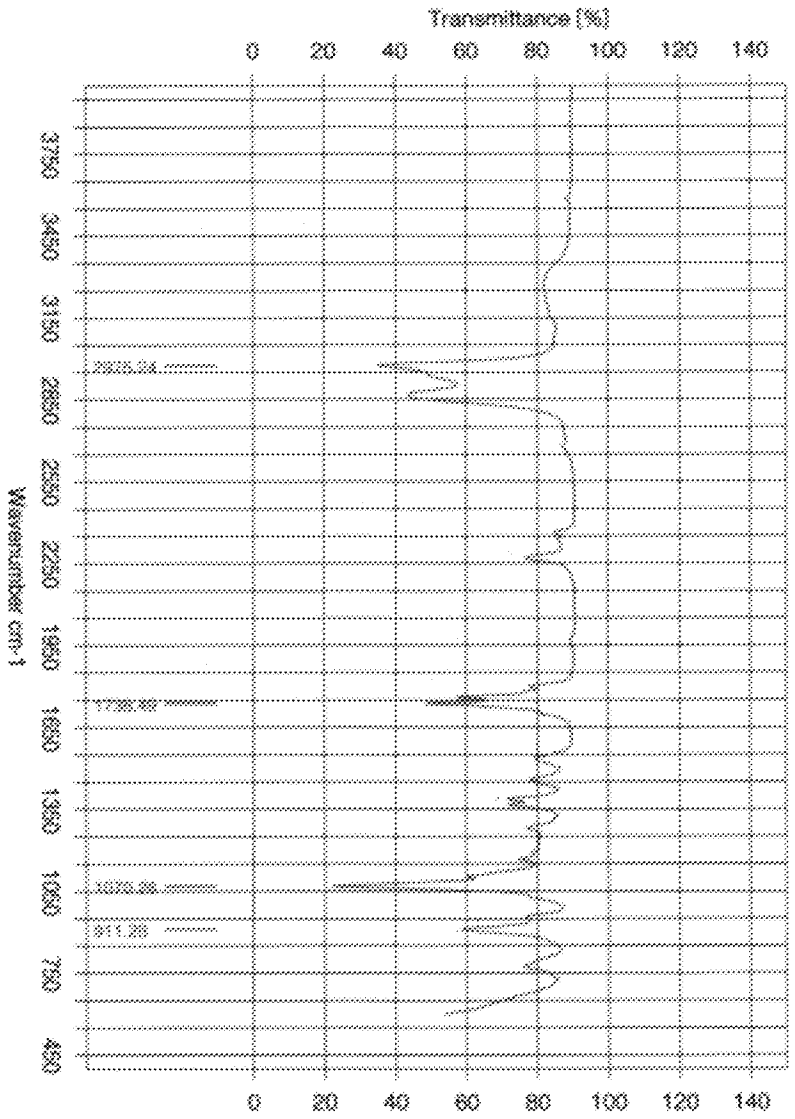
FIG. 2 is an FTIR spectrum of the DMH-CPTES adducted solution showing the absence of the 2271 $cm^{-1}$ NCO peak.

Using Fourier Transform Infrared ("FTIR") Spectroscopy, the presence or absence of the NCO group in the treated fabric can be identified. The FTIR spectra of DMH-CPTES solution before and after adduct formation, respectively, are shown in FIG. 1 and FIG. 2.

Before the reaction, samples show a significant band at 2271 $cm^{-1}$ (FIG. 1) which may be attributed to the stretching of the NCO group present in the unreacted solution. This is attributed to the NCO group present in unreacted CPTES compound.

The FTIR spectrum of the solution after 8 hours reaction (FIG. 2) shows the disappearance of the band at 2271 $cm^{-1}$. Thus, it is clear that NH site of DMH has reacted with NCO groups of the silane (CPTES) as a consequence of the above reaction taking place, resulting in the formation of a urea linkage between hydantoin and silane.

Example 5

Chlorination of Fabrics Treated with DMH-CPTES Adduct

DMH-CPTES adduct finished nylon/cotton blend fabric prepared as described in Example 2 was treated with sodium hypochlorite, to impart the antimicrobial property to the fabric.

DMH-CPTES adduct treated samples were saturated with sodium hypochlorite solution containing 13% available chlorine for 15 min at 80° C. and then 15 min at room temperature. The samples were dried at 60° C. overnight.

The dried, treated cloth was rinsed in hot deionized water, and was then washed three times with soapy water at 55-60° C. for 30 minutes. The cloth was then rinsed in hot deionized water.

The chlorination of the sample was done using sodium hypochlorite solution. The chlorination of DMH-CPTES adduct treated fabric samples were conducted at a concentration of (10%) NaOCl. NaOCl solution was made in water and then fabric samples were immersed in the solution for 15 min at 80° C. and then 15 min at room temperature. The fabric was then dried at 60° C. for 4 hour and then rinsed and washed.

Example 6

Evaluation of Antimicrobial Efficacy

N-Halamine-Silane treated fabrics, prepared as described in Example 5, were subjected to extensive antimicrobial activity testing using AATCC methods No. 147-2004 and No. 100-2004 using such organisms as *Staphylococcus aureus* (Gram Positive), *Escherichia Coli* (Gram Negative), and *Pseudomonas aeruginosa* (Gram Negative). Test results, summarized in Tables 2 and 3 show the very high antimicrobial activates of the treated fabrics.

TABLE 2

Results of the AATCC 147-2004 Test Method

| | *Staphylococcus aureus* | | *Escherichia coli* | |
|---|---|---|---|---|
| Type of Microbial Agent Used | Growth under the Sample | Zone of Inhibition (mm) | Growth under the Sample | Zone of Inhibition (mm) |
| N-Halamines and Silane coated 50/50, Nylon/cotton fabric (6% NaOCl) | No | 1.75 | No | 0 |
| N-Halamines and Silane coated 50/50, Nylon/cotton fabric (10% NaOCl) | No | 6.05 | No | 3.45 |
| Untreated Fabric | Yes | 0 | Yes | 0 |

TABLE 3

| Results of the AATCC 100-2004 Test Method CFU/sample | | | | | | |
|---|---|---|---|---|---|---|
| | Zero Contact Time | | 24-hours Contact Time | | % Reduction | |
| Fabric I.D. | *S. Aureus* | *P. aeruginosa* | *S. aureus* | *P. aeruginosa* | *S. aureus* | *P. aeruginosa* |
| Untreated Fabric | $4.7 \times 10^5$ | $5.1 \times 10^5$ | $5.9 \times 10^5$ | $3.4 \times 10^6$ | −25% | −57% |
| N-Halamine Treated Fabric | $4.4 \times 10^5$ | $5.4 \times 10^5$ | 0 | 0 | ≥99.99% | ≥99.99% |

Example 7

Evaluation of Treated Fabric Properties

Several physical properties of the N-halamine-Silane treated fabrics were determined and did not find any significant changes in the fabric's physical properties. Results are presented in Table 4 through 8.

TABLE 4

| Tensile Properties (ASTM D 5034 Method) | | | | |
|---|---|---|---|---|
| | Untreated Nylon/Cotton fabric | | N-Halamine and Silane coated Nylon/Cotton fabric | |
| | Breaking load, lbf | Elongation at rupture, % | Breaking load, lbf | Elongation at rupture, % |
| Average | 44.46 | 121.96 | 44.08 | 122.72 |
| Standard deviation | 5.11 | 2.73 | 3.86 | 2.99 |

TABLE 5

| Abrasion Resistance (ASTM D 4966 Method) | | |
|---|---|---|
| | Untreated Nylon/Cotton fabric Stiffness (milli-newton meters) | N-Halamine and Silane coated Nylon/Cotton fabric Stiffness (milli-newton meters) |
| Average | 2.92 | 2.95 |
| Standard deviation | 0.06 | 0.07 |

TABLE 6

| Fabric Stiffness (ASTM D 5342 Method) | | |
|---|---|---|
| | Untreated Nylon/Cotton fabric Stiffness (milli-newton meters) | N-Halamine and Silane coated Nylon/Cotton fabric Stiffness (milli-newton meters) |
| Average | 2.92 | 2.95 |
| Standard deviation | 0.06 | 0.07 |

TABLE 7

| Thermal Resistance of Fabric (ASTM F 1868 Method) | | |
|---|---|---|
| | Untreated Nylon/Cotton fabric Dry Thermal resistance, Rct-Rcbp | N-Halamine and Silane coated Nylon/Cotton fabric Dry Thermal resistance, Rct-Rcbp |
| Average | 0.019 $m^2$ ° C./W | 0.025 $m^2$ ° C./W |
| Standard deviation | 0.007 | 0.004 |

TABLE 8

| Evaporative Moisture Resistance (ASTM 1868 Method) | | |
|---|---|---|
| | Untreated Nylon/Cotton fabric Evaporative resistance, Rct-Rcbp | N-Halamine and Silane coated Nylon/Cotton fabric Evaporative resistance, Rct-Rcbp |
| Average | 3.297 $m^2$ ° C./W | 4.830 $m^2$ ° C./W |
| Standard deviation | 1.763 | 0.893 |

The treated samples provided very good antimicrobial properties even after three vigorous soap washings. The fabric durability properties such as tensile strength, abrasion resistance and stiffness and comfort properties such as thermal resistance and evaporative resistance did not exhibit significant changes.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

We claim:

1. A method of treating a fabric material to add an antimicrobial property to the fabric, said method comprising the steps of:

(a) reacting an isocyanate group of γ-isocyanatopropyl triethoxy silane with an NH site of a dimethyl hydantoin to forum a silane-hydantoin adduct;

(b) applying the silane-hydantoin adduct to a fabric material having cellulosic content;

(c) bonding the silane-hydantoin adduct to said fabric material in a substitution reaction to generate a silane-hydantoin substituted fabric material; and (d) reacting the silane-hydantoin substituted fabric material with a solution containing chlorine to create an antimicrobial fabric having an N-halamine structure thereon.

2. An antimicrobial fabric material which is prepared by the method of claim 1.

* * * * *